US010796713B2

(12) United States Patent
Du

(10) Patent No.: US 10,796,713 B2
(45) Date of Patent: Oct. 6, 2020

(54) IDENTIFICATION OF NOISE SIGNAL FOR VOICE DENOISING DEVICE

(71) Applicant: Alibaba Group Holding Limited, George Town (KY)

(72) Inventor: Zhijun Du, Hangzhou (CN)

(73) Assignee: Alibaba Group Holding Limited, George Town, Grand Cayman (KY)

( * ) Notice: Subject to any disclaimer, the term of this patent is extended or adjusted under 35 U.S.C. 154(b) by 104 days.

(21) Appl. No.: 15/951,928

(22) Filed: Apr. 12, 2018

(65) Prior Publication Data

US 2018/0293997 A1 Oct. 11, 2018

Related U.S. Application Data

(63) Continuation of application No. PCT/CN2016/101444, filed on Oct. 8, 2016.

(30) Foreign Application Priority Data

Oct. 13, 2015 (CN) ..... 2015 1 0670697

(51) Int. Cl.
*G10L 25/21* (2013.01)
*G10L 21/0232* (2013.01)
(Continued)

(52) U.S. Cl.
CPC ..... *G10L 25/21* (2013.01); *G10L 21/0232* (2013.01); *G10L 21/0324* (2013.01);
(Continued)

(58) Field of Classification Search
CPC ..... G10L 2021/02168; G10L 2025/783; G10L 21/0232; G10L 21/0324; G10L 25/21; G10L 25/51
See application file for complete search history.

(56) References Cited

U.S. PATENT DOCUMENTS 6,529,868 B1 * 3/2003 Chandran ..... G10L 21/0208 704/205
2003/0144840 A1 7/2003 Ma et al.
(Continued)

FOREIGN PATENT DOCUMENTS

CN 101197130 6/2008
CN 101853661 10/2010
(Continued)

OTHER PUBLICATIONS

International Search Report issued by the International Searching Authority in International Application No. PCT/CN2016/101444 dated Jan. 5, 2017; 11 pages.
(Continued)

*Primary Examiner* — Angela A Armstrong
(74) *Attorney, Agent, or Firm* — Fish & Richardson P.C.

(57) ABSTRACT

Methods, systems, and computer-readable storage media for voice denoising. Implementations include actions of performing a mathematical transform on each frame signal in an audio signal segment to generate multiple power spectra. Each power spectrum corresponds to a respective frame signal. Power value variances corresponding to frame signals at various frequencies are determined. A noise signal is identified in each frame signal based on the power value variance. The identified noise signal is removed from each frame signal of the plurality of frame signals.

20 Claims, 4 Drawing Sheets

(51) Int. Cl.

| | |
|---|---|
| ***G10L 25/51*** | (2013.01) |
| ***G10L 21/0324*** | (2013.01) |
| *G10L 21/0216* | (2013.01) |
| *G10L 25/78* | (2013.01) |

(52) U.S. Cl.
CPC .... *G10L 25/51* (2013.01); *G10L 2021/02168* (2013.01); *G10L 2025/783* (2013.01)

(56) References Cited

U.S. PATENT DOCUMENTS

| | | | |
|---|---|---|---|
| 2009/0296961 | A1 | 12/2009 | Takeuchi et al. |
| 2012/0070016 | A1 | 3/2012 | Yonekubo et al. |
| 2013/0003987 | A1 | 1/2013 | Furuta et al. |

FOREIGN PATENT DOCUMENTS

| | | | |
|---|---|---|---|
| CN | 101968957 | | 2/2011 |
| CN | 101968957 | A * | 2/2011 |
| CN | 102800322 | | 11/2012 |
| CN | 102314883 | | 1/2014 |
| CN | 103489446 | | 1/2014 |
| CN | 103632677 | | 3/2014 |
| CN | 103903629 | | 7/2014 |
| EP | 2031583 | | 3/2009 |
| EP | 2546831 | | 1/2013 |
| JP | H03180900 | | 8/1991 |
| JP | 836400 | | 2/1996 |
| JP | 2009216733 | | 9/2009 |
| JP | 2015158696 | | 9/2015 |

OTHER PUBLICATIONS

Crosby et al., "BlockChain Technology: Beyond Bitcoin," Sutardja Center for Entrepreneurship & Technology Technica Report, Oct. 16, 2015, 35 pages.

European Extended Search Report in European Patent Application No. 16854895.6, dated May 29, 2019, 7 pages.

Nakamoto, "Bitcoin: A Peer-to-Peer Electronic Cash System," www.bitcoin.org, 2005, 9 pages.

Search Report and Written Opinion in Singaporean Patent Application No. 11201803004Y, dated Aug. 8, 2019, 10 pages.

International Preliminary Report on Patentability in International Application No. PCT/CN2016/101444 dated Jan. 5, 2017; 10 pages.

* cited by examiner

IDENTIFICATION OF NOISE SIGNAL FOR VOICE DENOISING DEVICE

The application is a continuation of PCT Application No. PCT/CN2016/101444, filed on Oct. 8, 2016, which claims priority to Chinese Patent Application No. 201510670697.8, filed on Oct. 13, 2015, and each application is hereby incorporated by reference in its entirety.

BACKGROUND

Voice denoising technology can improve accuracy of processes associated to voice quality by removing environment noises from an audio (voice) signal. A voice denoising process includes an identification of a power spectrum of a noise signal in an audio signal. The audio signal can be denoised based on the determined power spectrum of the noise signal. The power spectrum of a noise signal in an audio signal can be determined by analyzing a set of initial frame signals in an audio signal segment with the assumption that the initial set of frame signals are noise signals. The initial set of frame signals is used to obtain the baseline of the power spectra of the noise signals in the audio signal. In an actual application scenario, the initial set of frame signals in an audio signal, which are assumed to include only noise signals, can include signals different from noise. Even if the initial set of frame signals includes only noise signals, the noise can vary over time such that the initially determined noise signals can be inconsistent with subsequent noise signals. Thus the accuracy of voice denoising technology based on identification of initial noise signals can be affected.

SUMMARY

Implementations of the present disclosure include computer-implemented methods for performing a voice denoising operation.

Implementations of the described subject matter, including the previously described implementation, can be implemented using a computer-implemented method; a non-transitory, computer-readable medium storing computer-readable instructions to perform the computer-implemented method; and a computer-implemented system comprising one or more computer memory devices interoperably coupled with one or more computers and having tangible, non-transitory, machine-readable media storing instructions that, if executed by the one or more computers, perform the computer-implemented method/the computer-readable instructions stored on the non-transitory, computer-readable medium.

The subject matter described in the specification can be implemented in particular implementations, so as to realize one or more of the following advantages. The implementations of the present disclosure include a method and a system for voice denoising. The voice denoising can include identification and removal of noise in multiple frames of an audio signal. The removal of actual noise from the audio signal improves the accuracy of the noise removal. The removal of actual noise from the audio signal eliminates the errors associated to derivation of noise signal power spectra based on the first N frame signals that are inconsistent with subsequent noise signals. The removal of actual noise from the audio signal increases the quality and efficiency of communications based on transmission of the audio signals.

The details of one or more implementations of the subject matter of the specification are set forth in the Detailed Description, the Claims, and the accompanying drawings. Other features, aspects, and advantages of the subject matter will become apparent to those of ordinary skill in the art from the Detailed Description, the Claims, and the accompanying drawings.

DESCRIPTION OF DRAWINGS

Like reference numbers and designations in the various drawings indicate like elements.

DETAILED DESCRIPTION

The following detailed description describes performing voice denoising, and is presented to enable any person skilled in the art to make and use the disclosed subject matter in the context of one or more particular implementations. Various modifications, alterations, and permutations of the disclosed implementations can be made and will be readily apparent to those of ordinary skill in the art, and the general principles defined can be applied to other implementations and applications, without departing from the scope of the present disclosure. In some instances, one or more technical details that are unnecessary to obtain an understanding of the described subject matter and that are within the skill of one of ordinary skill in the art can be omitted so as to not obscure one or more described implementations. The present disclosure is not intended to be limited to the described or illustrated implementations, but to be accorded the widest scope consistent with the described principles and features.

Noise transmitted during communications can overlap a user's voice affecting the quality and efficiency of the communication. Many voice-denoising methods are based on assumptions that are not always correct, leading to unreliable voice denoising. Identifying a noise signal in each frame signal of an audio signal and removing the actual (identified) noise signal from the audio signal segment can improve the accuracy and efficiency of communications and signal analysis.

Figure 1:
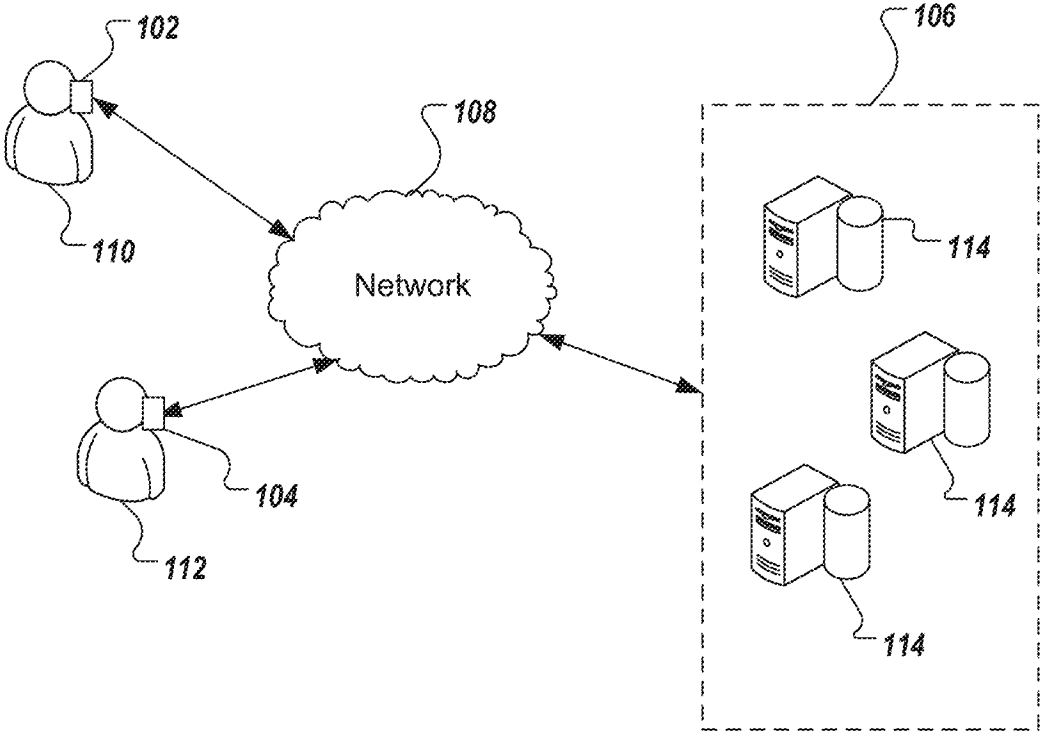
FIG. 1 is a block diagram illustrating an example of a system, according to an implementation of the present disclosure.

FIG. 1 depicts an example of a system 100 that can be used to execute implementations of the present disclosure. The example system 100 includes one or more user devices 102, 104, a server system 106, and a network 108. The user devices 102, 104 and the server system 106 can communicate with each other over the network 108. The server system 106 includes one or more server devices 114.

The users 110, 112 can interact with the user devices 102, 104, respectively. In an example context, the users 110, 112 can interact with a software application (or "application"), such as a voice based application, installed on the user devices 102, 104 that is hosted by the server system 106. The user devices 102, 104 can include a computing device such as a desktop computer, laptop/notebook computer, smart phone, smart watch, smart badge, smart glasses, tablet computer, another computing device, or a combination of computing devices, including physical or virtual instances of the computing device, or a combination of physical or virtual instances of the computing device. The user devices 102, 104 can be a static, a mobile or a wearable device. The user devices 102, 104 can include a communication module and a processor. The communication module can include an audio receiver (for example, a microphone), a radio frequency transceiver, a satellite receiver, a cellular network, a Bluetooth system, a Wi-Fi system (for example, 802.x), a cable modem, a DSL/dial-up interface, a private branch exchange (PBX) system, and/or appropriate combinations thereof. The communication modules of the user devices 102, 104 enable data to be transmitted from the client device 102 to the client device 104 and vice versa.

The user devices 102, 104 can include a plurality of components configured to perform operations associated to voice denoising, as described in detail with reference to FIG. 2. The user devices 102, 104 enables inputs and information display for the users 110, 112 using the audio receiver and a preset standard microphone conforming to a voice denoising protocol. In some implementations, the user devices 102, 104 can automatically process an audio signal to perform voice denoising for any application including processing or transmission of audio signals. The user devices 102, 104 can be configured to send denoised signals between each other.

In some implementations, the server system 106 can be provided by a third-party service provider, which stores and provides access to voice denoising applications. In the example depicted in FIG. 1, the server devices 114 are intended to represent various forms of servers including, but not limited to, a web server, an application server, a proxy server, a network server, or a server pool. In general, server systems accept requests for application services (such as, voice denoising services) and provides such services to any number of user devices (for example, the user devices 102, 104) over the network 108.

In accordance with implementations of the present disclosure, the server system 106 can host an voice denoising algorithm (for example, provided as one or more computer-executable programs executed by one or more computing devices) that applies voice denoising based on frame-by-frame noise identification and removal. The voice-denoising algorithm can be applied before transmitting audio signals to a receiver, such as one of the user devices 102, 104. In some implementations, the user devices 102, 104 can use the voice-denoising algorithm provided by the server system 106 and transmit the filtered audio signals to the user devices 102, 104 over the network 108 for the users 110, 112. In some implementations, the user devices 102, 104 transmit unfiltered audio (voice) signals to the server system 106 to filter the audio signals and the server system 106 can send the filtered audio signals to the user devices 102, 104 over the network 108 for the users 110, 112.

Figure 2:
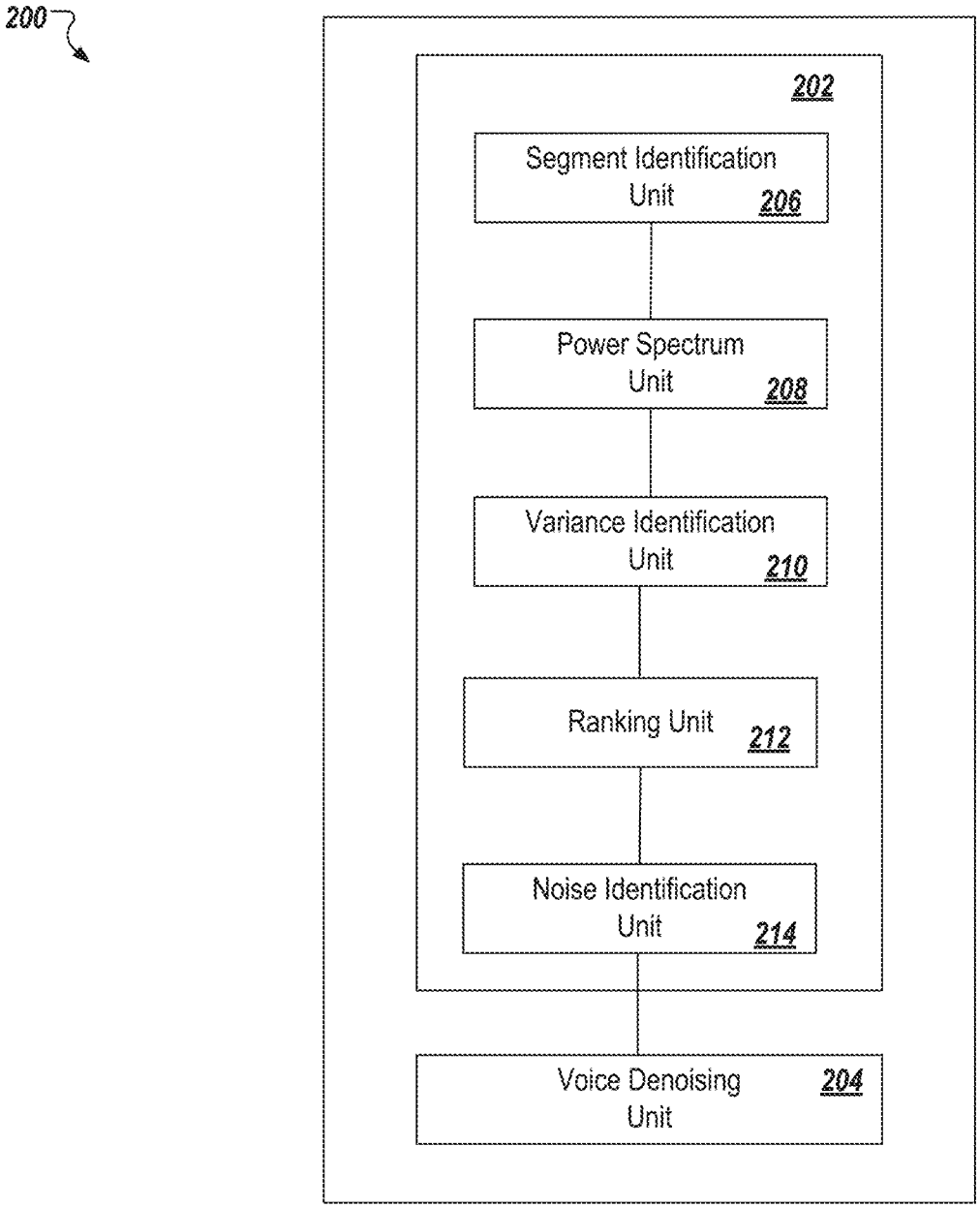
FIG. 2 is a block diagram illustrating an example of an architecture, according to an implementation of the present disclosure.

FIG. 2 illustrates an example of a block diagram of a voice-denoising device 200 (for example, user devices 102, 104 described with reference to FIG. 1) that can be used to execute implementations of the present disclosure. In the depicted example, the example voice-denoising device 200 includes a noise signal identification unit 202 and a voice-denoising unit 204. The noise identification unit 202 is specifically configured to determine whether each frame signal in an audio signal segment, including a voice signal, is a noise signal based on the variance of power values of each ranked frame signal at various frequencies. The voice-denoising unit 204 is configured to determine an average power corresponding to multiple noise frames included in the audio signal segment, and denoise the to-be-processed audio signal based on the average power of the noise frames.

The noise signal identification unit 202 includes a segment-identification unit 206, a power spectrum acquisition unit 208, a variance identification unit 210, a noise identification unit 212, and a voice-denoising unit 214. The segment identification unit 206 is configured to determine a to-be-analyzed audio signal segment included in a to-be-processed audio signal. In some implementations, the segment identification unit 206 is configured to determine or select based on one or more rules, an audio signal segment with an amplitude variation less than a preset threshold in a to-be-processed audio signal as the to-be-analyzed audio signal segment based on an amplitude variation of a time-domain signal of the to-be-processed audio signal. The rules can define the number of frames to form the segment. The frames can be selected relative to a reference frame (for example, a first recorded frame or a frame including a trigger signal). For example, the segment identification unit 206 can be configured to capture first N frame audio signals in a to-be-processed audio signal as the to-be-analyzed audio signal segment. The segment identification unit 206 transmits the to-be-analyzed audio signal segment to the power spectrum acquisition unit 208.

The power spectrum acquisition unit 208 is configured to perform mathematical transform (for example, Fourier transform) on each frame signal in the to-be-analyzed audio signal segment to generate a power spectrum of each frame signal in the audio signal segment. The power spectrum acquisition unit 208 transmits the power spectrum to the variance identification unit 210.

The variance identification unit 210 is configured to determine a variance of power values of each frame signal in the audio signal segment at various frequencies based on the power spectrum of the frame signal. In some implementations, the variance identification unit 210 can classify power values of the frame signal at various frequencies into power value sets corresponding to different frequency intervals of the power spectrum. The variance identification unit 210 can determine a first variance of power values included in the first power value set. The variance identification unit 210 transmits the variance of power values to the ranking unit 212.

The ranking unit 212 is configured to rank the frame signals in the to-be-analyzed audio signal segment according to magnitudes of the variances. The ranking unit 212 transmits the ranking to the noise identification unit 214.

The noise identification unit 214 is configured to determine whether each frame signal in the audio signal segment is a noise signal based on the variance, and obtain several noise frames included in the audio signal segment. For example, the noise identification unit 214 can determine whether the variance corresponding to each frame signal in the audio signal segment is greater than a threshold. If the noise identification unit 214 determines that the variance is below the threshold the frame signal is determined as a noise signal. The noise identification unit 214 transmits the noise signal to the voice-denoising unit 204.

The operations performed by the noise signal identification unit 202 can accurately determine several noise frames included in the to-be-analyzed audio signal segment. The voice-denoising unit 204 can denoise the to-be-processed audio signal based on an average power of the determined several noise frames in the voice denoising process, and thus the efficiency of voice denoising is improved.

Figure 3:
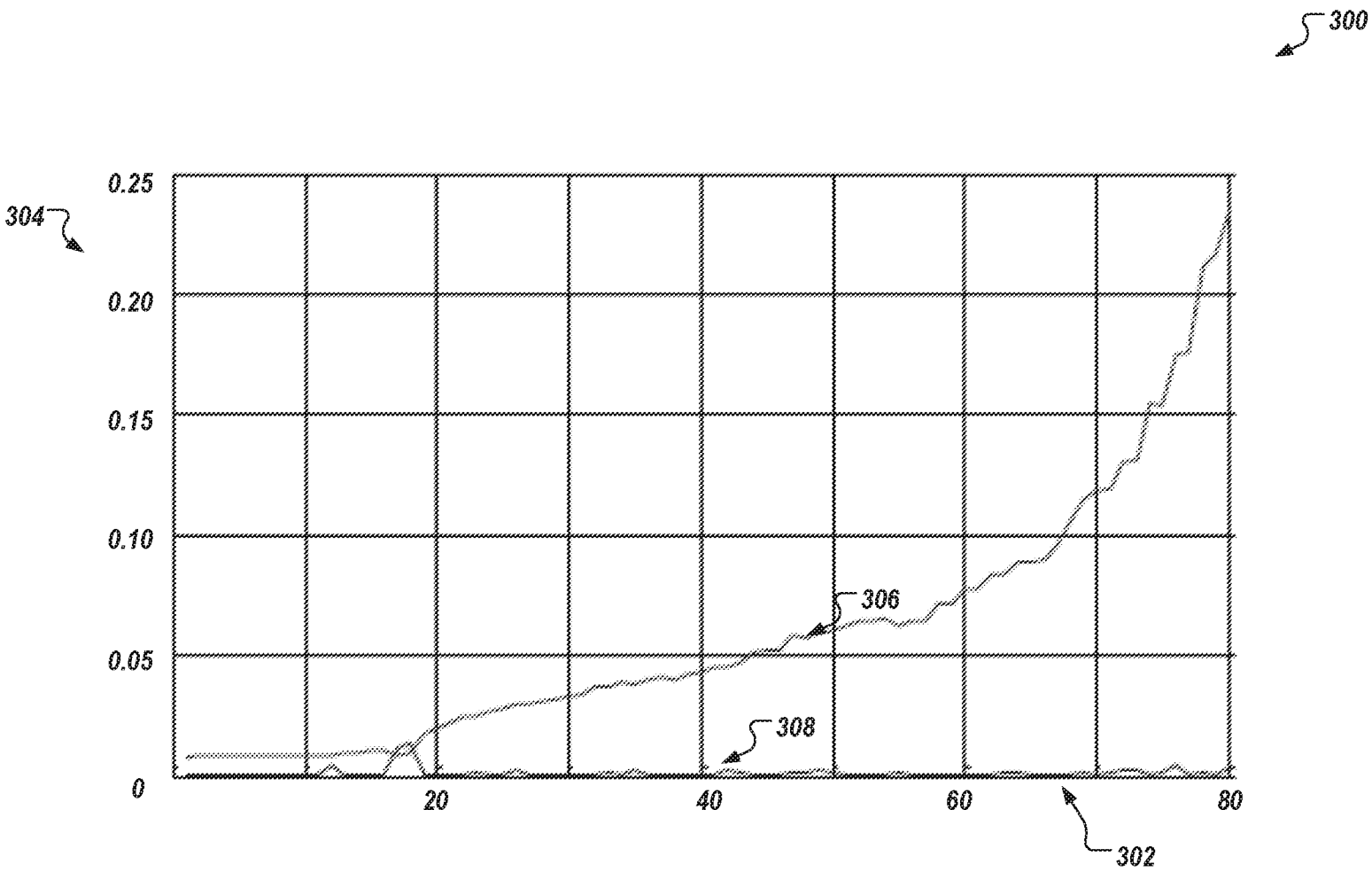
FIG. 3 is a curve graph of variances of power values, according to an implementation of the present disclosure.

FIG. 3 shows an example of a graph 300 according to an embodiment of the present application. In the example graph 300, the horizontal axis 302 indicates a temporal axis, represented by the frame number of a frame signal. The vertical axis 304 indicates the magnitude of a variance. The example graph 300 includes a representation of signal frequency relative to the frame signal 306 and a variance curve 308. The first variance curve 308 shows the trend of a first variance of each frame signal. The variance curve 308 shows the trend of a second variance of each frame signal. The variance curve 308 shows that the variance fluctuates slightly in the high frequency band 2000~4000 Hz, and the variance fluctuates greatly in the low frequency band 0~2000 Hz. The example graph 300 indicates that non-noise signals are mainly concentrated in the low frequency band.

Figure 4:
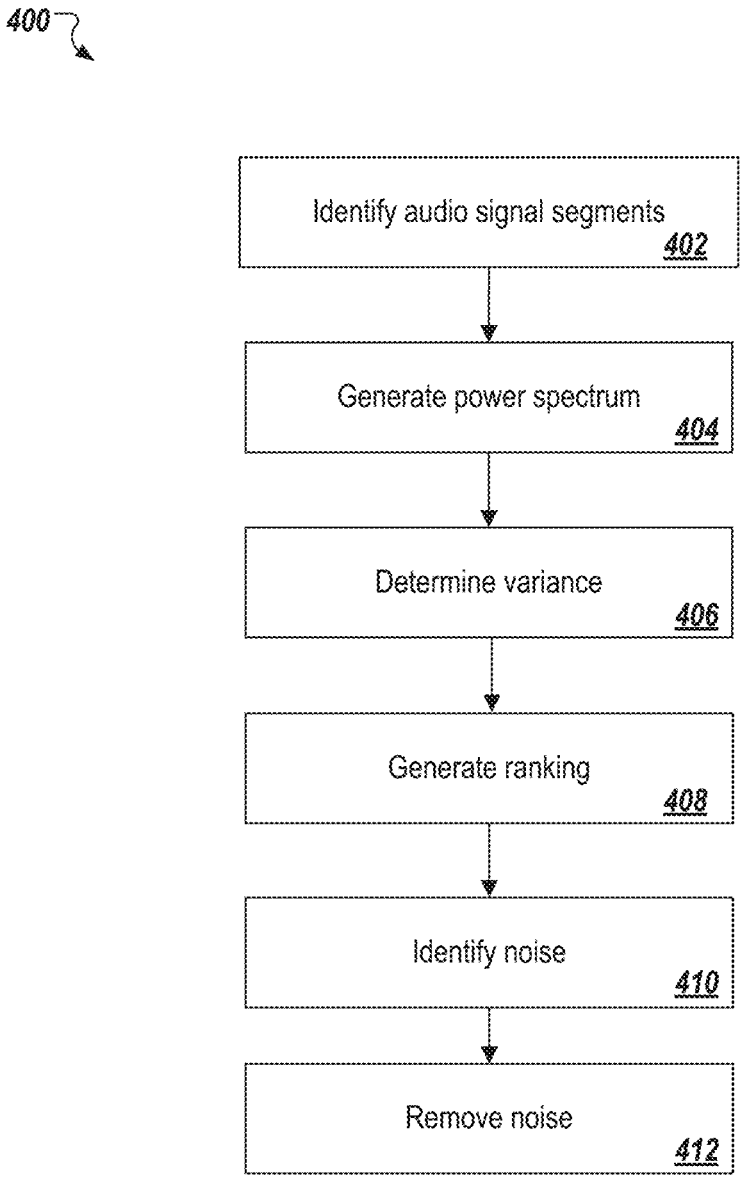
FIG. 4 is a flowchart illustrating examples of methods for performing a service operation, according to an implementation of the present disclosure.

FIG. 4 is a flowchart illustrating an example of a method 400 for performing voice denoising with a user device and a server, according to an implementation of the present disclosure. Method 400 can be implemented as one or more computer-executable programs executed using one or more computing devices, as described with reference to FIGS. 1 and 2. In some implementations, various steps of the example method 400 can be run in parallel, in combination, in loops, or in any order.

At 402, a to-be-analyzed audio signal segment included in a to-be-processed audio signal is determined. The to-be-analyzed audio signal segment can be a suspected noise frame segment that possibly includes many noise frames based on a preliminary determination. In some implementations, the preliminary determination includes identification of an audio signal segment with an amplitude variation less than a preset threshold in the to-be-processed audio signal as the to-be-analyzed audio signal segment based on an amplitude variation of a time-domain signal of the to-be-processed audio signal. In some implementations, the preliminary determination includes capturing a first set of frame audio signals (with a predefined number of frames) in the to-be-processed audio signal as the to-be-analyzed audio signal segment.

The to-be-analyzed audio signal segment can be captured from a to-be-processed audio signal based on a segmentation rule. The segmentation rule can define that in a time domain of an audio signal, a noise signal is generally an audio signal segment having a small amplitude variation or having consistent amplitudes. An audio signal segment including a human speech voice generally fluctuates greatly in amplitude variation in the time domain. Based on the segmentation rule, a preset threshold used for recognizing a "suspected noise frame segment" included in a to-be-processed audio signal (for example, a to-be-denoised voice) may be set in advance. The audio signal segment having an amplitude variation less than the preset threshold in the to-be-processed audio signal can be determined as the to-be-analyzed audio signal segment.

In some implementations, segmentation of the audio signal can be based on framing. A frame signal refers to a single-frame audio signal, and one audio signal segment can include several frame signals. One frame signal can include several sampling points, e.g., 1024 sampling points. Two adjacent frame signals can overlap each other (for example, an overlap ratio can be 50%). In this embodiment, a short-time Fourier transform (STFT) can be performed on an audio signal in a time domain to generate a power spectrum (frequency domain) of the audio signal. The power spectrum can include multiple power values corresponding to different frequencies, e.g., 1024 power values.

In some implementations, it can be generally assumed by default that an audio signal within a period of time (1.5 s) before a person speaks is a noise signal (an environment noise) in an audio signal segment including a human voice. The to-be-analyzed audio signal includes first N frame signals in an audio signal segment. For example, the to-be-analyzed audio signal is an audio signal in the first 1.5 s: $\{f_1', f_2', \ldots, f_n'\}$, wherein $f_1', f_2', \ldots, f_n'$ represent frame signals included in the audio signal respectively. From 402, method 400 proceeds to 404.

At 404, a Fourier transform is performed on each frame signal in the to-be-analyzed audio signal segment to generate a power spectrum of each frame signal in the audio signal segment. Multiple power values corresponding to each frame signal can be calculated based on the power spectrum of the to-be-analyzed audio signal: $\{f_1', f_2', \ldots, f_n'\}$ obtained after the STFT. Assume that a power spectrum of a frame signal at a frequency is a+bi, wherein the real part a can represent the amplitude and the imaginary part b can represent the phase. A power value of the frame signal at the frequency can be: $a^2+b^2$. Power values of each frame signal at different frequencies can be obtained based on the above process. For example, if each of the frame signals $\{f_1', f_2', \ldots, f_n'\}$ includes 1024 sampling points, 1024 power values of each frame signal at different frequencies can be obtained based on the power spectrum. For example, power values corresponding to the frame signal $f_1'$ is $\{p^1_1, p^1_2, \ldots, p^1_{1024}\}$, power values corresponding to the frame signal $f_2'$ is $\{p^2_1, p^2_2, \ldots, p^2_{1024}\}$, . . . , and power values corresponding to the frame signal $f_n'$ is $\{p^n_1, p^n_2, \ldots, p^n_{1024}\}$.

Power values of each of the frame signals $\{f_1', f_2', \ldots, f_n'\}$ at various frequencies are at least classified into a first power value set corresponding to a first frequency interval and a second power value set corresponding to a second frequency interval. The first frequency interval can be different from (lower than) the second frequency interval. From 404, method 400 proceeds to 406.

At 406, a variance of power values of each frame signal in the audio signal segment at various frequencies is determined based on the power spectrum of the frame signal. Based on the power values of frame signals $\{f_1', f_2', \ldots, f_n'\}$ at various frequencies, variances $\{Var(f_1'), Var(f_2'), \ldots, Var(f_n')\}$ of the power values of the frame signals $\{f_1', f_2', \ldots, f_n'\}$ can be calculated according to a variance calculation formula. For example, if each frame signal includes 1024 sampling points, $Var(f_1')$ is a variance of $\{p^1_1, p^1_2, \ldots, p^1_{1024}\}$, $Var(f_2')$ is a variance of $\{p^2_1, p^2_2, \ldots, p^2_{1024}\}$, . . . , and $Var(f_n')$ is a variance of $\{p^n_1, p^n_2, \ldots, p^n_{1024}\}$.

In some implementations, a variance of each frame signal can be generated in the frequency domain through statistics. Non-noise signals are generally concentrated in low-mid frequency bands, while noise signals are generally distributed uniformly in all frequency bands. The variance of power values of each frame signal at various frequencies can be generated through statistics in at least two different frequency bands corresponding to the frequency intervals.

For example, the first frequency interval can be 0~2000 Hz (low frequency band), and the second frequency interval can be 2000~4000 Hz (high frequency band). If each frame signal includes 1024 sampling points, 1024 power values corresponding to each frame signal are classified into a first power value set A corresponding to 0~2000 Hz and a second power value set B corresponding to 2000~4000 Hz according to the frequency intervals corresponding to the power values. Using the frame signal $f_1'$ as an example, 1024 corresponding power values are $\{p^1_1, p^1_2, \ldots, p^1_{1024}\}$. According to the frequency intervals, it can be derived that power values included in the first power value set A are, for example, $\{p^1_1, p^1_2, \ldots, p^1_{126}\}$, power values included in the first power set A are, for example, $\{p^1_{127}, p^1_{128}, \ldots, p^1_{1024}\}$, and the rest can be deduced by analogy. In some implementations, the variances of signal power values can be generated through statistics in more than two frequency bands.

A first variance of power values included in the first power value set can be determined. As described above, using the frame signal $f_1'$ as an example, power values included in the first power value set A are, for example, $\{p^1_{127}, p^1_{128}, \ldots, p^1_{1024}\}$. The first variation $Var_{high}(f_1')$ of the power values $p^1_{127}$~$p^1_{1024}$ can be calculated according to a variance formula.

A second variance of power values included in the second power value set can be determined. Using the frame signal $f_1'$ as an example, power values included in the second power value set B are, for example, $\{p^1_1, p^1_2, \ldots, p^1_{126}\}$. The second variation $Var_{low}(f_1')$ of the power values $p^1_1$~$p^1_{126}$ can be calculated according to the variance formula. From 406, method 400 proceeds to 408.

At 408, ranking is generated. The frame signals can be ranked in ascending order of the variances of power values. A signal with a smaller variance is more likely a noise signal. The noise frame signals in the to-be-analyzed audio signal can be ranked to the front. In the embodiment of the present application, if variances are respectively generated through statistics in the low frequency band (e.g., 0~2000 Hz) and the high frequency band (e.g., 2000~4000 Hz), power values of each of the frame signals $\{f_1', f_2', \ldots, f_n'\}$ at various frequencies can be classified into a first power value set A corresponding to a first frequency interval (e.g., 0~2000 Hz) and a second power value set B corresponding to a second frequency interval (e.g., 2000~4000 Hz) according to the frequency intervals to which frequencies corresponding to the power spectrum of the frame signal belong. Then first variances $\{Var_{low}(f_1'), Var_{low}(f_2'), \ldots, Var_{low}(f_n')\}$ of power values included in the first power value sets corresponding to the frame signals $\{f_1', f_2', \ldots, f_n'\}$ can be determined respectively, and second variances $\{Var_{high}(f_1'), Var_{high}(f_2'), \ldots, Var_{high}(f_n')\}$ of power values included in the second power value sets corresponding to the frame signals $\{f_1', f_2', \ldots, f_n'\}$ can be determined respectively. In some implementations, the step of ranking the frame signals according to the variances may be omitted, and noise frames can be determined directly based on variances of the original signals. From 408 method 400 proceeds to 410.

At 410, it is determined whether each frame signal in the audio signal segment is a noise signal based on the variance, and several noise frames included in the audio signal segment are obtained. The energy (for example, a power value) of a frame signal including a speech segment generally varies with bands greatly, while energy of a frame signal without a speech segment (i.e., a noise signal) varies with bands slightly and is evenly distributed. It can be determined whether each frame signal is a noise signal based on a variance of power values of the frame signal. In some implementations, an average power corresponding to several noise frames included in the audio signal segment is determined. For example, after noise frames $\{f_1', f_2', \ldots, f'_{m-1}\}$ included in a to-be-analyzed audio signal segment are generated according to the above method, frame numbers of original signals (before ranking) corresponding to the noise frames respectively can be determined, and an average power of these frame signals can be obtained through statistics to obtain a power spectrum estimation value $P_{noise}$ of the noise signal.

In some implementations, the noise is identified by determining whether the variance of the power values of the frame signal is greater than a first threshold $T_1$. If the variance of the power values of the frame signal is lower than a first threshold $T_1$, the frame signal is determined as a noise signal. If a variance of power values of a frame signal exceeds the first threshold $T_1$, it is indicated that a variation amplitude of energy (power values) of the frame signal with bands exceeds the first threshold $T_1$. In response, it is determined that the frame signal is not a noise signal. In contrast, if a variance of power values of a frame signal does not exceed the first threshold $T_1$, it is indicated that a variation amplitude of energy of the frame signal with bands does not exceed the first threshold $T_1$. In response, it is determined that the frame signal is a noise signal. The noise frame signals $\{f_1', f_2', \ldots, f_m'\}$ and non-noise frame signals $\{f_{m-1}, f_{m-2}, \ldots, f_n'\}$ can be determined sequentially in the to-be-analyzed audio signals $\{f_1', f_2', \ldots, f_n'\}$. The noise signals included in an audio signal segment can be determined and voice denoising can be performed according to these noise signals $\{f_1', f_2', \ldots, f_m'\}$.

In some implementations, the noise identification includes determining whether the first variance of the power values of the frame signal is greater than a first threshold $T_1$. In response to determining that the first variance of the power values of the frame signal is greater than a first threshold $T_1$, the frame signal is identified as being a noise signal. Using the frame signal $f_1$ as an example, it is determined whether the first variance $Var_{high}(f_1')$ is greater than the first threshold $T_1$. In some implementations, the noise identification includes determining whether a difference between the first variance and the second variance is greater than a second threshold $T_2$. In response to determining that the difference is below the threshold, the frame signal is identified as a noise signal. Using the frame signal $f_1'$ as an example, a difference between the first variance and the second variance is $|Var_{high}(f_1')-Var_{low}(f_1')|$. If $|Var_{high}(f_1')-Var_{low}(f_1')|>T_2$, the frame signal $f_1'$ is determined as a noise signal. Noise signals can be determined sequentially from the to-be-analyzed voice frame signals $\{f_1', f_2', \ldots, f_n'\}$ according to this step.

In some implementations, the noise identification is based on the variance of power values of each ranked frame signal at various frequencies. Noise signals included in the to-be-analyzed audio signals (which can be audio signals ranked according to magnitudes of variances) can be determined in the following manner:

$$Var_{low}(f_1')>T_1 \quad (1);$$

$$|Var_{high}(f_1')-Var_{low}(f_i')|>T_2 \quad (2);$$

$$Var_{high}(f'_{i+1})-Var_{high}(f_{i-1})>T_3 \quad (3);$$

$$Var_{high}(f'_{i+1})-Var_{low}(f'_{1-1})>T_4 \quad (4);$$

where $i \in (1, n)$. It can be determined based on formula (1) whether a first variance of power values of each frame signal $f_i'$ is greater than a first threshold $T_1$. If the first variance of power values of each frame signal $f_i'$ is lower than a first threshold $T_1$, the frame signal $f_i'$ is determined as a noise frame signal. The set of determined noise frame signals define the total noise signal.

It can be determined based on formula (2) whether a second variance of power values of each frame signal is greater than a second threshold $T_2$. In response to determining that the variance of power values of each frame signal $f_i'$ is lower than a second threshold $T_2$, the frame signal $f_i'$ is determined as being a noise frame signal. The set of determined noise frame signals define the total noise signal*.

It can be determined based on formula (3) whether a difference $Var_{high}(f'_{i+1})-Var_{high}(f'_{i-1})$ between a second variance $Var_{high}(f'_{i-1})$ of power values of a frame signal $f'_{i-1}$ prior to a frame signal $f_i'$ and a second variance $Var_{high}(f'_{i+1})$ of power values of a frame signal $f'_{i+1}$ next to the frame signal $f_i'$ is greater than a third threshold $T_3$. If the difference is lower than the fourth threshold $T_3$, the frame signal $f_i'$ is determined as a noise frame signal. The set of determined noise frame signals define the total noise signal.

It can be determined based on formula (4) whether a difference $Var_{low}(f'_{i+1})-Var_{low}(f'_{i-1})$ between a first variance $Var_{low}(f'_{i-1})$ of power values of a frame signal $f'_{i-1}$ prior to a frame signal $f_i'$ and a first variance $Var_{low}(f'_{i+1})$ of power values of a frame signal $f'_{i-1}$ next to the frame signal $f_i'$ is greater than a fourth threshold $T_4$. If the difference is lower than the fourth threshold $T_4$, the frame signal $f_i'$ is determined as a noise frame signal. The set of determined noise frame signals define the total noise signal.

In some implementations, noise frames included in the to-be-analyzed audio signal can be determined by using the above formulas (1) to (4). For example, any frame signal f satisfying the conditions expressed by any one of the above formulas (1) to (4) can be determined as a noise free signal. Any frame signal $f_i'$ that does not satisfy any of the above formulas (1) to (4) is identified as a noise signal. A frame with noise $f_m'$ (noise end frame) can be determined based on the above process, and the noise frames include: $\{f_1', f_2', \ldots, f'_{m-1}\}$.

In some implementations, the noise end frame can be determined based on some of the formulas (1) to (4), such as the formulas (1) and (2), or the formulas (2) and (3). The formulas for identification the noise end frame in the embodiment of the present application are not limited to the formulas listed above. The thresholds $T_1$, $T_2$, $T_3$, and $T_4$ are all obtained from statistics on a large quantity of testing samples. From 410 method 400 proceeds to 412.

At 412, noise is removed from the audio signal. In some implementations, denoising is based on the average power of the noise frames. After 412, method 400 stops.

The foregoing description method 400 describes a solution implementation process on a terminal device side. Correspondingly, the implementations of the present application also propose a solution implementation procedure on a server side. The method 400 can be implemented to a server corresponding to a service application of a particular type, wherein the server communicates with a terminal device using a preset standard microphone included in the terminal device. The server can receive a service request of the service application. The server sends a voice denoising request message to the terminal device using the preset standard microphone included in the terminal device. If a voice-denoising request succeeds, the server receives a verification response message that is transmitted by the terminal device using the preset standard microphone and includes service authentication information. The server processes the service request according to the service authentication message. In some implementations, before the server receives the service request of the service application, a process of pre-storing service authentication information is included. The process of pre-storing service authentication information includes sending, by the server, a binding registration request message for an account to the terminal device using the preset standard microphone included in the terminal device. The binding registration request message includes service authentication information of the account. If registration binding succeeds the server receives a registration response message that is transmitted by the terminal device using the preset standard microphone. The server can acknowledge that the terminal device is successfully bound to the account. The registration response message includes an identifier information of the terminal device. The pre-storage process corresponds to the operation process of locally pre-storing service authentication information by the terminal device in step 406. If the service authentication information of the account needs to be updated, the server sends a service authentication information update request message for the account to the terminal device using the preset standard microphone included in the terminal device. The service authentication information update request message includes the service authentication information available to be updated of the account. In some implementations, after the server processes the service request according to the service authentication message, a corresponding acknowledgment process may be included. The server sends an acknowledgment request including acknowledgment manner type information to the terminal device using the preset standard microphone included in the terminal device. The terminal device can complete a corresponding acknowledgment operation according to the acknowledgment manner type information. Each message received by the terminal device using the preset standard microphone can include at least operation type information and signature information of the message. The signature information needs to match the service application corresponding to the preset standard microphone, and therefore can be verified according to the public key of the service application. If verification fails, the server can be determine that the current message does not match the particular type. Based on the matching results, an unrelated message can be filtered out, and the security can be improved.

The implementations of the present application disclose a method and a device for voice-denoising, implemented to a system composed of a server and a terminal device including a preset standard microphone configured to receive an audio signal to be processed by a service application of a particular type. By means of the technical solutions proposed in the present application, if a voice-denoising operation is required, the server can request service authentication information of an account of the service application from the user device using the preset standard microphone.

Embodiments of the subject matter and the operations described in this specification can be implemented in digital electronic circuitry, or in computer software, firmware, or hardware, including the structures disclosed in this specification and their structural equivalents, or in combinations of one or more of them. Embodiments of the subject matter described in this specification can be implemented as one or more computer programs, that is, one or more modules of computer program instructions, encoded on non-transitory computer storage media for execution by, or to control the operation of, data processing apparatus. Alternatively or in addition, the program instructions can be encoded on an artificially generated propagated signal, for example, a machine-generated electrical, optical, or electromagnetic signal, that is generated to encode information for transmission to suitable receiver apparatus for execution by a data processing apparatus. A computer storage medium can be, or be included in, a computer-readable storage device, a computer-readable storage substrate, a random or serial access memory array or device, or a combination of one or more of them. Moreover, while a computer storage medium is not a propagated signal, a computer storage medium can be a source or destination of computer program instructions encoded in an artificially generated propagated signal. The computer storage medium can also be, or be included in, one or more separate physical components or media (for example, multiple Compact Discs (CDs), Digital Video Discs (DVDs), magnetic disks, or other storage devices).

The operations described in this specification can be implemented as operations performed by a data processing apparatus on data stored on one or more computer-readable storage devices or received from other sources.

The terms "data processing apparatus," "computer," or "computing device" encompass all kinds of apparatus, devices, and machines for processing data, including by way of example a programmable processor, a computer, a system on a chip, or multiple ones, or combinations, of the foregoing. The apparatus can include special purpose logic circuitry, for example, a central processing unit (CPU), a field programmable gate array (FPGA) or an application specific integrated circuit (ASIC). The apparatus can also include, in addition to hardware, code that creates an execution environment for the computer program in question, for example, code that constitutes processor firmware, a protocol stack, a database management system, an operating system (for example, LINUX, UNIX, WINDOWS, MAC OS, ANDROID, IOS, another operating system, or a combination of operating systems), a cross-platform runtime environment, a virtual machine, or a combination of one or more of them. The apparatus and execution environment can realize various different computing model infrastructures, such as web services, distributed computing and grid computing infrastructures.

A computer program (also known as a program, software, software application, software module, software unit, script, or code) can be written in any form of programming language, including compiled or interpreted languages, declarative or procedural languages, and it can be deployed in any form, including as a stand-alone program or as a module, component, subroutine, object, or other unit suitable for use in a computing environment. A computer program may, but need not, correspond to a file in a file system. A program can be stored in a portion of a file that holds other programs or data (for example, one or more scripts stored in a markup language document), in a single file dedicated to the program in question, or in multiple coordinated files (for example, files that store one or more modules, sub programs, or portions of code). A computer program can be deployed to be executed on one computer or on multiple computers that are located at one site or distributed across multiple sites and interconnected by a communication network.

Processors suitable for the execution of a computer program include, by way of example, both general and special purpose microprocessors, and any one or more processors of any kind of digital computer. Generally, a processor will receive instructions and data from a read only memory or a random access memory or both. The essential elements of a computer are a processor for performing actions in accordance with instructions and one or more memory devices for storing instructions and data. Generally, a computer will also include, or be operatively coupled to receive data from or transfer data to, or both, one or more mass storage devices for storing data, for example, magnetic, magneto optical disks, or optical disks. However, a computer need not have such devices. Moreover, a computer can be embedded in another device, for example, a mobile device, a personal digital assistant (PDA), a game console, a Global Positioning System (GPS) receiver, or a portable storage device (for example, a universal serial bus (USB) flash drive), to name just a few. Devices suitable for storing computer program instructions and data include all forms of non-volatile memory, media and memory devices, including, by way of example, semiconductor memory devices, for example, erasable programmable read-only memory (EPROM), electrically erasable programmable read-only memory (EEPROM), and flash memory devices; magnetic disks, for example, internal hard disks or removable disks; magneto optical disks; and CD ROM and DVD-ROM disks. The processor and the memory can be supplemented by, or incorporated in, special purpose logic circuitry.

Mobile devices can include mobile telephones (for example, smartphones), tablets, wearable devices (for example, smart watches, smart eyeglasses, smart fabric, smart jewelry), implanted devices within the human body (for example, biosensors, smart pacemakers, cochlear implants), or other types of mobile devices. The mobile devices can communicate wirelessly (for example, using radio frequency (RF) signals) to various communication networks (described below). The mobile devices can include sensors for identification characteristics of the mobile device's current environment. The sensors can include cameras, microphones, proximity sensors, motion sensors, accelerometers, ambient light sensors, moisture sensors, gyroscopes, compasses, barometers, fingerprint sensors, facial recognition systems, RF sensors (for example, Wi-Fi and cellular radios), thermal sensors, or other types of sensors.

To provide for interaction with a user, embodiments of the subject matter described in this specification can be implemented on a computer having a display device, for example, a cathode ray tube (CRT) or liquid crystal display (LCD) monitor, for displaying information to the user and a keyboard and a pointing device, for example, a mouse or a trackball, by which the user can provide input to the computer. Other kinds of devices can be used to provide for interaction with a user as well; for example, feedback provided to the user can be any form of sensory feedback, for example, visual feedback, auditory feedback, or tactile feedback; and input from the user can be received in any form, including acoustic, speech, or tactile input. In addition, a computer can interact with a user by sending documents to and receiving documents from a device that is used by the user; for example, by sending web pages to a web browser on a user's client device in response to requests received from the web browser.

Embodiments of the subject matter described in this specification can be implemented using computing devices interconnected by any form or medium of wireline or wireless digital data communication (or combination thereof), for example, a communication network. Examples of communication networks include a local area network (LAN), a radio access network (RAN), a metropolitan area network (MAN), and a wide area network (WAN). The communication network can include all or a portion of the Internet, another communication network, or a combination of communication networks. Information can be transmitted on the communication network according to various protocols and standards, including Worldwide Interoperability for Microwave Access (WIMAX), Long Term Evolution (LTE), Code Division Multiple Access (CDMA), 5G protocols, IEEE 802.11a/b/g/n or 802.20 protocols (or a combination of 802.11x and 802.20 or other protocols consistent with the present disclosure), Internet Protocol (IP), Frame Relay, Asynchronous Transfer Mode (ATM), ETHERNET, or other protocols or combinations of protocols. The communication network can transmit voice, video, data, or other information between the connected computing devices.

Embodiments of the subject matter described in this specification can be implemented using clients and servers interconnected by a communication network. A client and server are generally remote from each other and typically interact through a communication network. The relationship of client and server arises by virtue of computer programs running on the respective computers and having a client-server relationship to each other.

While this specification contains many specific implementation details, these should not be construed as limitations on the scope of any inventive concept or on the scope of what can be claimed, but rather as descriptions of features that can be specific to particular implementations of particular inventive concepts. Certain features that are described in this specification in the context of separate implementations can also be implemented, in combination, in a single implementation. Conversely, various features that are described in the context of a single implementation can also be implemented in multiple implementations, separately, or in any sub-combination. Moreover, although previously described features can be described as acting in certain combinations and even initially claimed as such, one or more features from a claimed combination can, in some cases, be excised from the combination, and the claimed combination can be directed to a sub-combination or variation of a sub-combination.

Particular implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations can be considered optional), to achieve desirable results. In certain circumstances, multi-tasking or parallel processing (or a combination of multi-tasking and parallel processing) can be advantageous and performed as deemed appropriate.

Moreover, the separation or integration of various system modules and components in the previously described implementations should not be understood as requiring such separation or integration in all implementations, and it should be understood that the described program components and systems can generally be integrated together in a single software product or packaged into multiple software products.

Accordingly, the previously described example implementations do not define or constrain the present disclosure. Other changes, substitutions, and alterations are also possible without departing from the spirit and scope of the present disclosure.

Furthermore, any claimed implementation is considered to be applicable to at least a computer-implemented method; a non-transitory, computer-readable medium storing computer-readable instructions to perform the computer-implemented method; and a computer system comprising a computer memory interoperably coupled with a hardware processor configured to perform the computer-implemented method or the instructions stored on the non-transitory, computer-readable medium.

What is claimed is:

1. A computer-implemented method for voice denoising, the method being executed by one or more processors and comprising:

performing, by the one or more processors, a mathematical transform on each frame signal in an audio signal segment comprising a plurality of frame signals to generate a plurality of power spectra, each power spectrum of the plurality of power spectra corresponding to a respective frame signal;

determining, by the one or more processors, a plurality of power value variances, each power value variance of the plurality of power value variances corresponding to the respective frame signal by classifying power values of each frame signal at various frequencies into a first power value variance corresponding to a first frequency interval and a second power value variance corresponding to a second frequency interval;

generating, by the one or more processors, a ranking of the plurality of frame signals in the audio signal segment according to magnitudes of the plurality of power value variances by determining for each frame signal of the plurality of frame signals:

whether a first condition is satisfied, the first condition comprising the first power value variance being greater than a first threshold, whether a second condition is satisfied, the second condition comprising the second power value variance being greater than a second threshold, whether a third condition is satisfied, the third condition comprising a difference between the second power value variance at the respective frame signal and the second power value variance at a subsequent frame signal being greater than a third threshold, and whether a fourth condition is satisfied, the fourth condition comprising a difference between the second power value variance and the first power value variance is greater than a fourth threshold;

in response to determining that at least one of the first condition, the second condition, the third condition and the fourth condition fails to be satisfied, identifying, by the one or more processors, a noise signal in the respective frame signal of the plurality of frame signals based on the ranking of the plurality of frame signals in the audio signal segment; and removing, by the one or more processors, the noise signal from the respective frame signal of the plurality of frame signals from the audio signal segment.

2. The computer-implemented method of claim 1, further comprising determining the audio signal segment based on comparing an amplitude variation to a threshold.

3. The computer-implemented method of claim 1, wherein identifying the noise signal comprises comparing the each power value variance corresponding to the respective frame signal in the audio signal segment to a noise threshold.

4. The computer-implemented method of claim 1, wherein determining the plurality of power value variances comprises:

at least classifying power values of the frame signal at various frequencies into a first power value set corresponding to a first frequency interval according to frequency intervals corresponding to the plurality of power spectra; and determining a first variance of power values comprised in the first power value set.

5. The computer-implemented method of claim 1, wherein the first frequency interval is lower than the second frequency interval.

6. The computer-implemented method of claim 1, wherein the ranking of the plurality of frame signals in the audio signal segment comprises a low ranking frame signal comprising a small variance that is smaller than an average variance of the plurality of power value variances and a high ranking frame signal comprising a high variance that is greater than the average variance.

7. The computer-implemented method of claim 1, further comprising: in response to ranking the frame signals, determining whether each frame signal in the audio signal segment is a noise signal based on the each power value variance of each ranked frame signal at various frequencies.

8. A non-transitory, computer-readable medium storing one or more instructions executable by a computer system to perform operations for performing voice denoising, the operations comprising:

performing a mathematical transform on each frame signal in an audio signal segment comprising a plurality of frame signals to generate a plurality of power spectra, each power spectrum of the plurality of power spectra corresponding to a respective frame signal;

determining a plurality of power value variances, each power value variance of the plurality of power value variances corresponding to the respective frame signal by classifying power values of each frame signal at various frequencies into a first power value variance corresponding to a first frequency interval and a second power value variance corresponding to a second frequency interval;

generating a ranking of the plurality of frame signals in the audio signal segment according to magnitudes of the plurality of power value variances by determining for each frame signal of the plurality of frame signals:

whether a first condition is satisfied, the first condition comprising the first power value variance being greater than a first threshold, whether a second condition is satisfied, the second condition comprising the second power value variance being greater than a second threshold, whether a third condition is satisfied, the third condition comprising a difference between the second power value variance at the respective frame signal and the second power value variance at a subsequent frame signal being greater than a third threshold, and whether a fourth condition is satisfied, the fourth condition comprising a difference between the second power value variance and the first power value variance is greater than a fourth threshold;

in response to determining that at least one of the first condition, the second condition, the third condition and the fourth condition fails to be satisfied, identifying a noise signal in the respective frame signal of the plurality of frame signals based on the ranking of the plurality of frame signals in the audio signal segment; and removing the noise signal from the respective frame signal of the plurality of frame signals from the audio signal segment.

9. The non-transitory, computer-readable medium of claim 8, the operations further comprising determining the audio signal segment based on comparing an amplitude variation to a threshold.

10. The non-transitory, computer-readable medium of claim 8, wherein identifying the noise signal comprises comparing the each power value variance corresponding to the respective frame signal in the audio signal segment to a noise threshold.

11. The non-transitory, computer-readable medium of claim 9, wherein determining the plurality of power value variances comprises:

at least classifying power values of the frame signal at various frequencies into a first power value set corresponding to a first frequency interval according to frequency intervals corresponding to the plurality of power spectra; and determining a first variance of power values comprised in the first power value set.

12. The non-transitory, computer-readable medium of claim 8, wherein the first frequency interval is lower than the second frequency interval.

13. The non-transitory, computer-readable medium of claim 8, wherein the ranking of the plurality of frame signals in the audio signal segment comprises a low ranking frame signal comprising a small variance that is smaller than an average variance of the plurality of power value variances and a high ranking frame signal comprising a high variance that is greater than the average variance.

14. The non-transitory, computer-readable medium of claim 8, the operations further comprising in response to ranking the frame signals, determining whether each frame signal in the audio signal segment is a noise signal based on the each power value variance of each ranked frame signal at various frequencies.

15. A computer-implemented system for voice denoising, comprising:

one or more computers; and one or more computer memory devices interoperably coupled with the one or more computers and having tangible, non-transitory, machine-readable media storing instructions that, if executed by the one or more computers, perform operations comprising:

performing a mathematical transform on each frame signal in an audio signal segment comprising a plurality of frame signals to generate a plurality of power spectra, each power spectrum of the plurality of power spectra corresponding to a respective frame signal;

determining a plurality of power value variances, each power value variance of the plurality of power value variances corresponding to the respective frame signal by classifying power values of each frame signal at various frequencies into a first power value variance corresponding to a first frequency interval and a second power value variance corresponding to a second frequency interval;

generating a ranking of the plurality of frame signals in the audio signal segment according to magnitudes of the plurality of power value variances by determining for each frame signal of the plurality of frame signals:

whether a first condition is satisfied, the first condition comprising the first power value variance being greater than a first threshold, whether a second condition is satisfied, the second condition comprising the second power value variance being greater than a second threshold, whether a third condition is satisfied, the third condition comprising a difference between the second power value variance at the respective frame signal and the second power value variance at a subsequent frame signal being greater than a third threshold, and whether a fourth condition is satisfied, the fourth condition comprising a difference between the second power value variance and the first power value variance is greater than a fourth threshold;

in response to determining that at least one of the first condition, the second condition, the third condition and the fourth condition fails to be satisfied, identifying a noise signal in the respective frame signal of the plurality of frame signals based on the ranking of the plurality of frame signals in the audio signal segment; and removing the noise signal from the respective frame signal of the plurality of frame.

16. The computer-implemented system of claim 15, the operations further comprising determining the audio signal segment based on comparing an amplitude variation to a threshold.

17. The computer-implemented system of claim 15, wherein identifying the noise signal comprises comparing the each power value variance corresponding to the respective frame signal in the audio signal segment to a noise threshold.

18. The computer-implemented system of claim 15, wherein determining the plurality of power value variances comprises:

at least classifying power values of the frame signal at various frequencies into a first power value set corresponding to a first frequency interval according to frequency intervals corresponding to the plurality of power spectra; and determining a first variance of power values comprised in the first power value set.

19. The computer-implemented system of claim 15, wherein the first frequency interval is lower than the second frequency interval.

20. The computer-implemented system of claim 15, wherein the ranking of the plurality of frame signals in the audio signal segment comprises a low ranking frame signal comprising a small variance that is smaller than an average variance of the plurality of power value variances and a high ranking frame signal comprising a high variance that is greater than the average variance.

* * * * *